US005868985A

United States Patent [19]

Frischmann

[11] Patent Number: 5,868,985

[45] Date of Patent: Feb. 9, 1999

[54] PROCESS FOR MANUFACTURING CELLULOSE FIBERS

[75] Inventor: Gunter Frischmann, Bickenbach, Germany

[73] Assignee: Akzo Nobel NV, Arnhem, Netherlands

[21] Appl. No.: 913,169

[22] PCT Filed: Mar. 19, 1996

[86] PCT No.: PCT/EP96/01173

§ 371 Date: Sep. 8, 1997

§ 102(e) Date: Sep. 8, 1997

[87] PCT Pub. No.: WO96/30566

PCT Pub. Date: Oct. 3, 1996

[30] Foreign Application Priority Data

Mar. 31, 1995 [DE] Germany ..... 195 12 053.1

[51] Int. Cl.[6] ..... D01F 2/02

[52] U.S. Cl. ..... 264/180; 264/187; 264/210.8; 264/211.12; 264/211.14

[58] Field of Search ..... 264/180, 187, 264/203, 210.8, 211.12, 211.14

[56] References Cited

U.S. PATENT DOCUMENTS 5,417,909 5/1995 Michels et al. ..... 264/177.13

FOREIGN PATENT DOCUMENTS

| | | |
|---|---|---|
| 172 001 | 2/1986 | European Pat. Off. . |
| 574 870 | 12/1993 | European Pat. Off. . |
| 44 09 609 | 10/1994 | Germany . |
| 61-19805 | 1/1986 | Japan . |

OTHER PUBLICATIONS

Abstract of Japan 59–228,012 (Published Dec. 21, 1984).

*Primary Examiner*—Leo B. Tentoni
*Attorney, Agent, or Firm*—Oliff & Berridge, PLC

[57] ABSTRACT

A process for manufacturing cellulose fibers by extrusion of a spinning solution, containing dissolved cellulose, into a gaseous medium through a predetermined gas zone, with subsequent immersion in and guidance through a coagulation bath over a predetermined coagulation zone, drawing the cellulose fibers obtained and winding them up, characterized in that after the gas zone the extruded spinning solution is immersed in a coagulation bath accelerated to a predetermined velocity and flowing laminarly at least approximately in the direction of the extruded spinning solution, whereby the coagulation liquid is fed laterally into the path of the spinning solution and the flow direction of the spinning solution and the coagulation liquid is kept approximately parallel throughout the entire coagulation zone, and in that the cellulose fibers obtained are laterally deflected upon leaving the coagulation zone and then wound up.

14 Claims, 1 Drawing Sheet

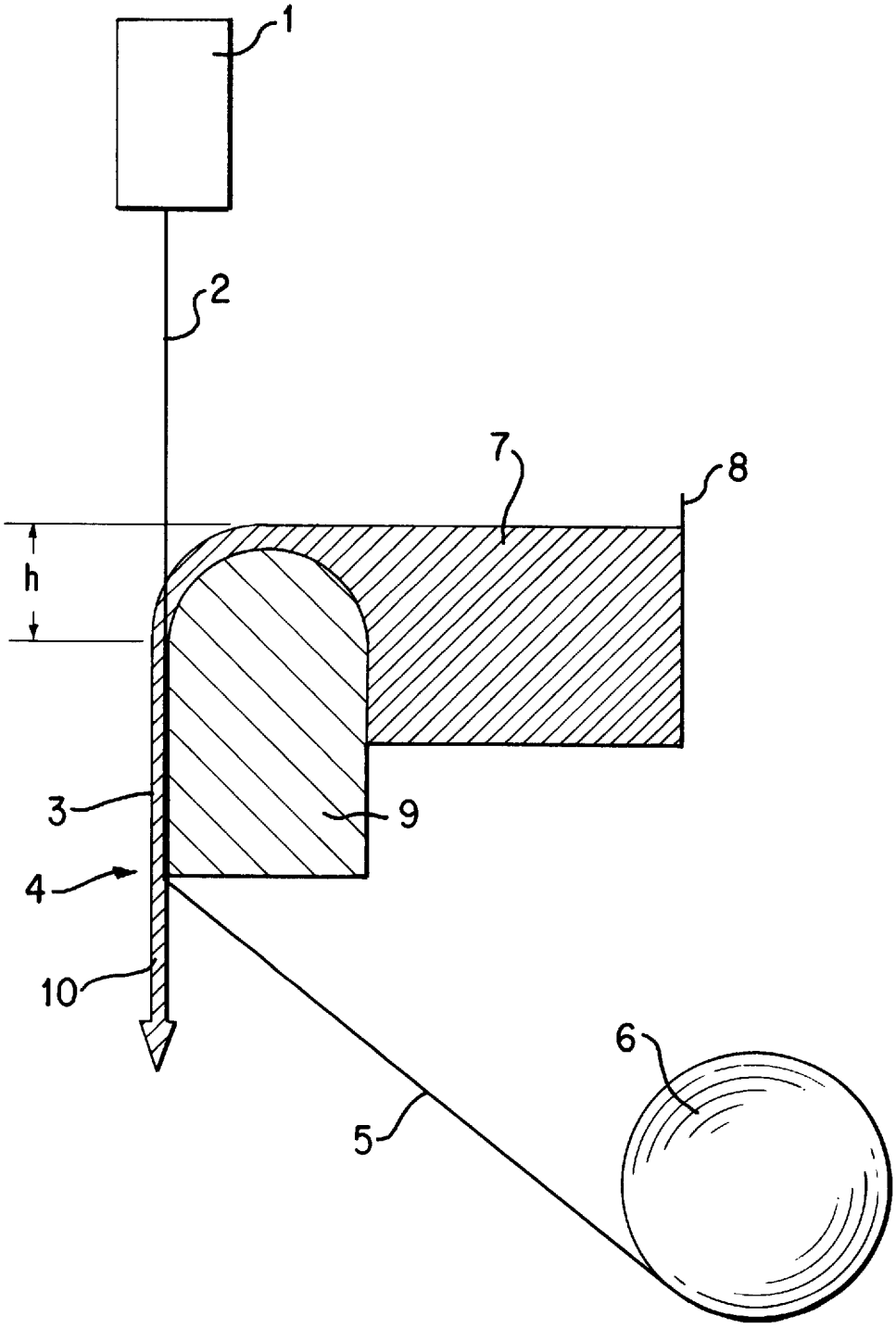
1
2
7
8
h
3
9
4
10
6
5

PROCESS FOR MANUFACTURING CELLULOSE FIBERS

BACKGROUND OF THE INVENTION

The invention relates to a process for manufacturing cellulose fibers by extrusion of a spinning solution, containing dissolved cellulose, into a gaseous medium through a predetermined gas zone, with subsequent immersion in and guidance through a coagulation bath over a predetermined coagulation zone, drawing the cellulose fibers obtained and winding them up.

Such a process is for example known from DE-A-4409609. The spinning solution is immersed in a stationary coagulation bath after passage through the gas zone, and the coagulation bath is then accelerated along with the spinning solution. The acceleration of the coagulation bath takes place via a spinning funnel which is conically tapered at the bottom. Such a spinning funnel has the disadvantage that the spinning initiation poses considerable problems. The maximum winding velocity obtainable is 150 m/min according to the examples, so that this known process is not very economical.

An additional process of this type is known from JP-A-61-19805, where again the spinning solution is extruded into a spinning funnel, whereby due to the encapsulation of the gas zone, the gas atmosphere into which the spinning solution is extruded is strongly enriched with the coagulation liquid, causing hereby a pre-coagulation in the gas zone which is not always desirable. In this known process the coagulation liquid is to be guided as a stream over the wall of the spinning funnel, resulting in turbulence right at the point of contact between the spinning solution and the coagulation liquid. This turbulence causes frequent spinning breaks so that this process only leads to a stable spinning process when using spinning solutions with very little cellulose. The examples state winding velocities of up to 1500 m/min. However, this is obtained by costly arrangements of several acceleration funnels, which in the first place renders the spinning initiation difficult and secondly makes a stable spinning process considerably more complicated.

BRIEF DESCRIPTION OF THE DRAWING

The FIG. depicts an apparatus for manufacturing fibers according to the present invention.

The objective of the present invention is to make a further spinning process for the production of cellulose fibers available, which works more economically. In particular, it should at least reduce the above mentioned disadvantages. It should also provide a process for the production of cellulose fibers which is also stable even at winding velocities exceeding 1000 m/min, and with sensitive cellulose spinning solutions, such as is the case with solutions of cellulose in a water-containing N-oxide of a tertiary amine, particularly N-methylmorpholine-N-oxide (NMMO).

This objective is met by the process of the type initially described in that, after the gas zone, the extruded spinning solution is introduced into a coagulation bath accelerated to a predetermined velocity and flowing laminarly at least approximately in the direction of the extruded spinning solution, whereby the coagulation liquid is fed laterally into the path of the spinning solution and the flow direction of the spinning solution and the coagulation liquid is kept at least approximately parallel throughout the entire coagulation zone, and in that the cellulose fibers obtained are deflected laterally when leaving the coagulation zone and are subsequently wound up.

The lateral laminar feeding of the coagulation liquid can be easily obtained in that one side of a reservoir for the coagulation liquid is formed as a spillway, whereby the spillway is shaped in such a way that the coagulation liquid on the one hand flows along the contour and on the other hand is redirected from the horizontal into the flow direction of the spinning solution. This contour can in a simple case be shaped like a quarter circle or a parabola, but attention should be paid to the fact that a steady curve is formed from the outlet to the transition into the flow direction of the spinning solution to guarantee that turbulence is for the most part avoided, so that the spinning solution can be immersed in a laminar coagulation liquid stream. It is favorable if the spillway, after the point of transition into the flow direction of the spinning solution, continues still further parallel to the flow direction of the spinning solution up to the end of the coagulation zone, whereby the bottom edge of the spillway can then be used to deflect the resulting cellulose filament by having a laterally offset winding device pull the filament produced over the bottom edge of the spillway.

The process of the invention is suited for the production of fibers, whereby the term fibers is understood to mean monofilaments, multifilament threads and also hollow filaments. The process is equally well suited for the production of porous fibers. The fibers can possess a round as well as a profiled cross-section.

The production of cellulose fibers according to the invention succeeds particularly well if the coagulation liquid is fed from one side into the spinning solution with a constant stream depth ranging from 1.0 mm to 5 mm. Hereby it is particularly advantageous if the stream depth is adjusted to approximately 1 to 3 times the depth of the largest diameter of the extruded spinning solution. It is particularly simple to guarantee the stream depth for the spillway, which is described above in further detail, in that an amount of coagulation liquid is fed into the coagulation liquid reservoir so that the desired stream depth is formed on the spillway at the tangential outlet. Of course, care should be taken hereby that the coagulation liquid is at least fed into the reservoir in a steady state, without causing turbulence in the reservoir. The means necessary for this are sufficiently known by one skilled in the art and therefore do not need to be explained in further detail.

DETAILED DESCRIPTION OF PREFERRED EMBODIMENTS

For the process of invention it is recommended that the velocity of the coagulation liquid is adjusted so that at the immersion point of the spinning solution, a value ranging between 30 and 200 m/min and preferably between 50 and 80 m/min is achieved, whereby the production of the cellulose fibers succeeds particularly well if the coagulation zone is adjusted to a length between 0.5 and 8 cm, preferably between 1 and 4 cm.

The velocity at the immersion point can be determined in the process, which is described above in further detail, by the height difference between the liquid level in the reservoir and the immersion point of the spinning solution, that is the point at which the spillway turns into the flow direction of the spinning solution. The velocity at the immersion point is equal to the square root of the product of two times the gravitational acceleration multiplied by the height difference (the velocity squared is equal to the product of two times the gravitational acceleration multiplied by the height difference). If such a spillway is used, the coagulation zone will easily be determined from the portion the spillway between the immersion point and the bottom edge of the spillway.

In order to remove, in a particularly satisfactory manner, the coagulation liquid from the cellulose filament at the exit of the coagulation zone, it has been found to be most effective if the coagulated cellulose fibers are deflected at an angle ranging between 45° and 60° to the flow direction of the coagulation liquid after the coagulation zone. Hereby it is recommended to abruptly deflect the cellulose fibers away from the flow direction of the coagulation liquid after passing through the coagulation zone. Abruptly, in the sense of the present invention, is understood to mean that the fibers obtained change their direction of movement in a very small area which amounts to only a few millimeters. In this case it is advantageous if after the coagulation zone, the cellulose fibers obtained are deflected abruptly from the flow direction of the coagulation liquid in such a way that they form a radius of 0.2 to 2 mm, and preferably a radius between 0.3 and 1 mm, in the deflection area. This can be achieved by the above mentioned spillway in that the bottom edge of the spillway has an appropriate radius.

The process of the invention has been shown to be particularly advantageous for a solution of cellulose in a water-containing an N-oxide of a tertiary amine, particularly N-methylmorpholine-N-oxide (NMMO), as a spinning solution.

The invention will be explained in further detail with reference to one figure and the following examples.

The figure schematically depicts a spinneret 1, from which a spinning solution 2 is spun into a gaseous medium, for example ambient air, and the spinning solution is then immersed in a coagulation liquid flowing downwards and remains in this coagulation liquid up to deflection point 4, after which filament 5, which has in the meantime coagulated, is abruptly deflected toward winding device 6 and this filament is then wound up by means of the winding device 6, for example on a bobbin, which is not additionally depicted, situated on the winding device. During the abrupt deflection at the deflection point 4, most of the coagulation liquid flows further downward (see stream 10 with arrow), so that at least most of the coagulation liquid is removed from filament 5. In this case it has been shown advantageous if the filament is pulled away at an angle between 45° and 60°, which is formed between stream 10 and filament 5.

A reservoir 8 is provided for the coagulation liquid 7, into which a constant amount of coagulation liquid is fed with as little turbulence as possible by means which are not depicted. In order to obtain a stream of the coagulation liquid 7/3 that is as laminar as possible at the immersion point, the reservoir 8 of the coagulation liquid 7 is confined by a spillway 9 with respect to the direction of the spinning solution 2, whereby through continuous and constant feeding of coagulation liquid 7 into the reservoir 8, a certain depth of the coagulation liquid stream, which is at least substantially laminar and is flowing to the spinning solution 2, is attained. The velocity of the coagulation liquid at the immersion point of the spinning solution 2 is determined by the height difference h between the liquid level of the coagulation liquid 7 in the reservoir 8 and the transition of the curve of spillway 9 into the vertical. As previously mentioned, the velocity of the coagulation liquid at the immersion point is calculated by the square root of the product of two times the gravitational acceleration multiplied by the height difference h.

In the following the invention will be explained in further detail by reference to comparison examples and examples of the invention.

EXAMPLES

The spinning solution employed contains in all examples 15% cellulose, 10% water and 75% NMMO, which was produced from chemical wood pulp V65, obtainable from Buckeye, using the known technique for manufacturing NMMO spinning solutions. The spinning solution, which was maintained at a temperature of 120° C., was spun into air. The orifice diameter of the spinneret used measured 200 mm, whereby the mass indicated by the flow rate m in the table was extruded through the spinneret. After a gas zone of 18 cm the spinning solution entered a coagulation bath and at the end of the bath it was drawn off toward the winding device at an angle of 60° to the actual flow direction of the spinning solution. It was there wound up at a filament velocity $v_{sp}$, which was selected so that the filament could be wound up without breaking. $V_{sp}$ is the maximum winding velocity at which no break occurred when manufacturing the filaments. In examples 1 to 4 (comparison examples) a stationary coagulation bath was employed (velocity of the coagulation bath liquid at the immersion point was $u_E$=0 m/min), whereas in examples 5 to 8 the apparatus described in the figure was used, whereby the velocity $u_E$ prevailed at the immersion point of the spinning solution. Further process data and results are summarized in the following table.

TABLE

| Example | | 1 | 2 | 3 | 4 | 5 | 6 | 7 | 8 |
|---|---|---|---|---|---|---|---|---|---|
| m | g/h | 27.5 | 34.2 | 49.1 | 88.4 | 35.3 | 37.0 | 43.2 | 57.6 |
| $u_E$ | m/min | 0 | 0 | 0 | 0 | 60 | 60 | 60 | 60 |
| $v_{SP}$ | m/min | 850 | 950 | 990 | 850 | 1210 | 1200 | 1200 | 1200 |
| Titer | dtex | 0.81 | 0.9 | 1.24 | 2.6 | 0.73 | 0.77 | 0.9 | 1.2 |

The examples demonstrate that significantly higher winding velocities can be utilized if the process of the invention is used rather than a common stationary coagulation bath.

What is claimed is:

1. A process for manufacturing fibers comprising extruding a spinning solution through a gaseous medium of a predetermined gas zone, subsequently immersing the extruded spinning solution into a coagulation liquid being fed laterally to the flow direction of the spinning solution, and being accelerated to a predetermined velocity and flowing laminarly and at least approximately in the flow direction of the extruded spinning solution before the spinning solution is immersed into the coagulation liquid, guiding the spinning solution through the coagulation liquid over a predetermined coagulation zone to obtain fibers, whereby the flow direction of the coagulation liquid is kept at least approximately parallel to the flow direction of the extruded spinning solution throughout the entire coagulation zone, laterally deflecting the fibers upon leaving the coagulation zone, drawing the fibers, and winding up the fibers.

2. Process according to claim 1, wherein the coagulation liquid is fed into the spinning solution from one side with a constant stream depth ranging from 1.0 to 5 mm.

3. Process according to claim 2, wherein the stream depth is about 1 to 3 times the largest diameter of the extruded spinning solution.

4. Process according to claim 1, wherein the velocity of the coagulation liquid at the immersion point of the spinning solution is between 30 and 200 m/min.

5. Process according to claim 4, wherein the velocity of the coagulation liquid is between 50 and 80 m/min.

6. Process according to claim 1, wherein the coagulation zone has a length of 0.5 to 8 cm.

7. Process according to claim 6, wherein the coagulation zone has a length of 1 to 4 cm.

8. Process according to claim 1, wherein the fibers are laterally deflected after the coagulation zone at an angle between 45° and 60° to the flow direction of the coagulation liquid.

9. Process according to claim 1, wherein the fibers are abruptly deflected after the coagulation zone from the flow direction of the coagulation liquid.

10. Process according to claim 1, wherein the fibers are abruptly deflected after the coagulation zone from the flow direction of the coagulation liquid in such a way that the fibers form a radius of 0.2 to 2 mm in the deflection area.

11. Process according to claim 10, wherein the fibers form a radius between 0.3 and 1 mm.

12. Process according to claim 1, wherein the spinning solution comprises a solution of cellulose in a water-containing N-oxide of a tertiary amine.

13. Process according to claim 12, wherein the N-oxide of a tertiary amine is N-methylmorpholine-N-oxide (NMMO).

14. Process according to claim 1, wherein the fibers are cellulose fibers.

* * * * *